United States Patent [19]

Nash

[11] Patent Number: 4,641,627

[45] Date of Patent: Feb. 10, 1987

[54] IGNITION MODULE

[75] Inventor: Donald R. Nash, Berkey, Ohio

[73] Assignee: Allied Corporation, Morris County, N.J.

[21] Appl. No.: 730,226

[22] Filed: May 3, 1985

[51] Int. Cl.[4] ..... F02P 1/08; F02P 3/12; F02P 1/02

[52] U.S. Cl. ..... 123/651; 123/601; 123/149 D; 123/595

[58] Field of Search ..... 123/651, 601, 595, 149 D, 123/189 A, 652, 647, 594, 596, 599; 310/70 R, 70 A

[56] References Cited

U.S. PATENT DOCUMENTS

| | | | |
|---|---|---|---|
| 3,447,521 | 6/1969 | Piteo | 123/601 |
| 3,484,677 | 12/1969 | Piteo | 322/91 |
| 3,908,622 | 9/1975 | Long | 123/595 |
| 3,938,491 | 2/1976 | Mozza | 123/149 D |
| 4,036,201 | 7/1977 | Busion | 123/601 |
| 4,117,820 | 10/1978 | Kashiwrzaki et al. | 123/149 D |
| 4,163,437 | 8/1979 | Notaras et al. | 123/148 |
| 4,270,509 | 6/1981 | Tharman | 123/647 |

FOREIGN PATENT DOCUMENTS

| | | | |
|---|---|---|---|
| 0030078 | 10/1980 | United Kingdom | 123/595 |

*Primary Examiner*—Raymond A. Nelli

*Attorney, Agent, or Firm*—Allegretti, Newitt, Witcoff & McAndrews, Ltd.

[57] ABSTRACT

A ignition module for an ignition system originally fitted with mechanical breaker points. The module comprising a drive winding adapted to be circumferentially received about one of the legs of a core for generating a first induced voltage signal in response to engine rotation. The module further comprising a control circuit extending from the drive winding and positioned between a core leg and an ignition coil.

8 Claims, 4 Drawing Figures

IGNITION MODULE

BACKGROUND AND SUMMARY OF THE INVENTION

This invention relates to a solid state breakerless ignition module which may be supplied as a retrofit package enabling the replacement of the more conventional mechanically actuated breaker points.

To control the generation of a spark in an ignition system, many such systems utilized a pair of breaker points which were moved in synchronism with the combustion cycle within the engine by a cam. These breaker points require manual setting to achieve the proper ignition timing and typically have a relatively limited life because of the wearing down of a rubbing block moved by the cam. In addition, the electrical contacts of the breaker points are subject to pitting and electrical corrosion due to the electrical arcing that often occurs thereacross further limiting its useful life.

Further, the packaging of an ignition system especially for a small engine such as a chain saw, lawn mower, or the like, is especially critical since available space is at a premium. Such is not the case for ignition systems for larger automotive engines. The present invention is directed to a retrofit ignition module which can be used to convert the conventional mechanical breaker ignition system into a solid state, breakerless ignition system and as such the module and related circuitry must be sufficiently compact to be packaged and received within the exsisting confines of the ignition system. One such ignition system is illustrated in U.S. Pat. No. 4,270,509 which uses separate biasing coil wound about an additional ferromagnetic core which is thereafter fitted to the main core of the magneto. The present invention avoids the complicated mounting requirements of the above system and is not sensitive to air gap variations of the additional core.

It is a general object of the present invention to provide a retrofit ignition module for a mechanical breaker ignition system that can be quickly and easily installed as a replacement for a mechanical points and condensor. It is a further object of the invention to provide such ignition module which is compact and able to fit within the existing space requirements of the small engine ignition system.

Accordingly, the invention comprises; a retrofit ignition module for an ignition system having a generally U-shaped core, including a crossbar and two substantially parallel extending legs. The ignition system further includes an ignition coil wound about the crossbar including a primary and a secondary coil winding. The ignition module comprises a user replaceable drive winding adapted to be circumferentially positioned about one of the legs of the core for generating a first induced control signal in response to a varying flux field produced by the movement of the magnet across the end faces of the legs. The ignition module further includes a circuit cantilevered from the drive winding and positioned within the main core between the drive winding and the ignition coil. The control circuit being responsive to the induced control signal and connected in circuit between the drive winding and the primary winding and operable to control the flow of current through the primary winding.

Many other objects, features and purposes of the invention will be clear from the following detailed description of the drawings.

DETAILED DESCRIPTION OF THE DRAWINGS

Figure 1:
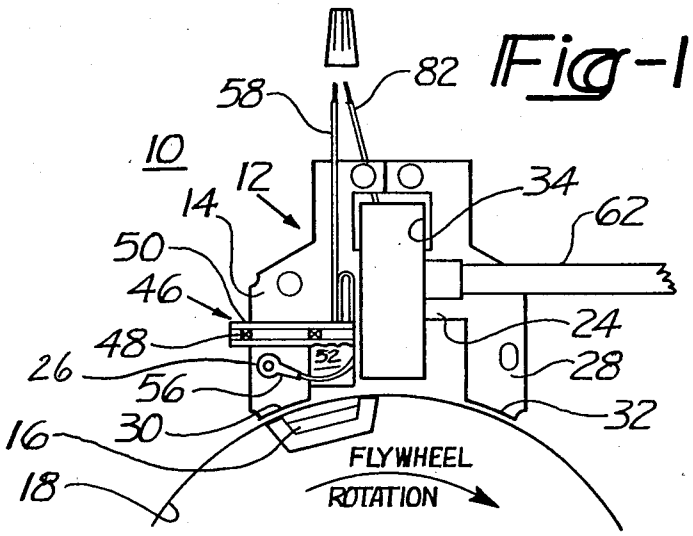
FIG. 1 is a cross-sectional view of a magneto incorporating the present invention.

With reference to FIG. 1 there is illustrated an ignition system 10 comprising a magneto generally designated as 12. The magneto comprises a generally U-shaped stator core 14 fixedly positioned to the engine and a permanent magnet 16 fixed to and rotatable with a rotating engine component such as the flywheel 18. The stator comprises a crossbar 24 and a plurality of parallel extending legs 26 and 28, each of which terminate at a pole face 30 and 32 respectively. Positioned about the crossbar 24 is an ignition coil 34 comprising a primary winding 36 and a secondary winding 38 which are more clearly illustrated in FIG. 2.

Supported on one of the poles, such as pole 26, which is first encountered by the magnet 16 as it is rotated by the flywheel 18, is a retrofit ignition module generally designated as 46. The ignition module comprises a drive winding 48 wound about a bobbin 50. The bobbin 50 supports a control circuit generally designated as 52 which is similarly shown in more detail in FIG. 2. The ignition module 46 comprises a ground wire 56 that is mounted in a known manner to the stator 14 and an output wire 58 which is attached to one of the ends 60 of the primary winding after such winding has been disconnected from the mechanical breaker points previously used within the ignition system. The wires 58 and 60 may be soldered together or connected by a solderless nut connection. A spark plug wire generally shown as 62 connects the secondary winding 36 to the spark plug as illustrated in FIG. 2.

Figure 3:
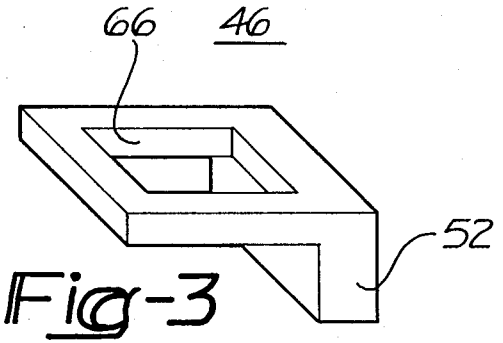
FIG. 3 illustrates a projected view of an ignition module.

FIG. 3 illustrates a projected view of the ignition module 46. In the illustrated embodiment of the invention, each of the extending legs 26 and 28 comprises a substantially rectangular cross-sectional area and as such the bobbin 50 defines a substantially rectangular opening 66 through which the leg 26 is received as the ignition module is fitted in place thereon. The control circuitry 52 extending from the bobbin 50 of the ignition module 46 is positioned between the leg 26 of the core or stator 14 and the primary ignition coil 34. The ignition module may be press fit or tightly received about leg 26, thereby securing it in place or alternatively once positioned on the leg 26, it may be secured thereto by epoxy or the like.

Figure 2:
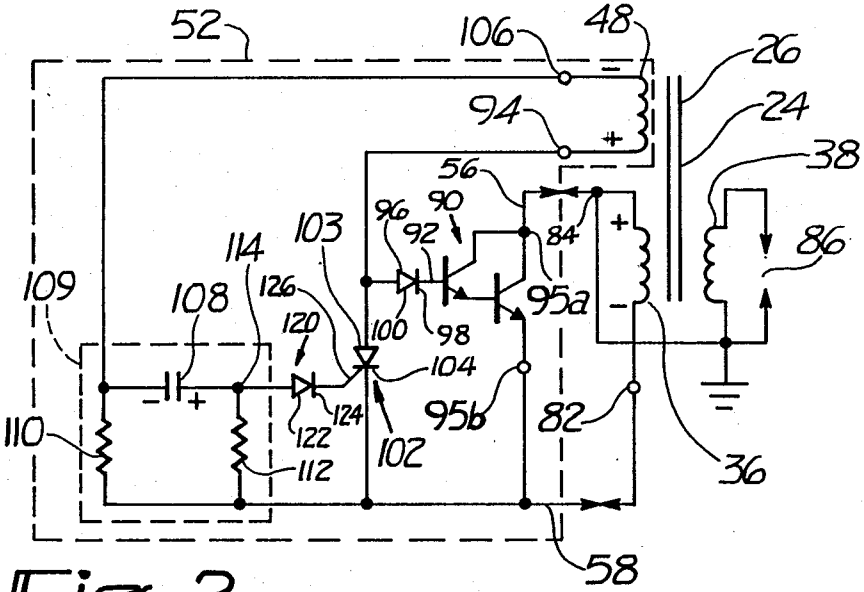
FIG. 2 illustrates the control circuit of the present invention.

With reference to FIG. 2, there is illustrated the control circuit 52 of the present invention. The control circuit 52 is attached via the wire 58 to one terminal 82 of the primary winding 36 and connected to ground via the wire 56 and to the other terminal 84 of the primary winding 36. Further, FIG. 2 illustrates the schmeatic orientation between the primary coil 36, the secondary coil 38 and a spark plug 86. The stator or core 14 is shown schematically in FIG. 1 with the crossbar 24 coupling the primary and secondary windings an the extending leg 26 magnetically coupling the drive winding 48.

As will be seen from the discussion below, the control circuit output wire 58 is connected to that terminal 82 of the primary coil 36 that is made negative by the voltage induced therein just prior to the firing of the spark plug 86. The ground wire 56 of the control circuit 52 is connected to the other terminal 84 of the primary winding, such terminal may be floating or grounded. The control circuit 52 includes a first semiconductor switch generally designated as 90 having an input 92 connected to one terminal 94 of the drive coil 48 and an ouput 95*a–b* which is connected in parallel across the primary winding 36. In the illustrated embodiment of the invention the semiconductor switch 90 comprises a Darlington pair having its input 92 connected to the cathode 98 of the diode 96. The anode 100 of the diode 96 is connected to the terminal 94 of the drive winding 46. Further in the embodiment illustrated in FIG. 2 the Darlington pair comprises a plurality of NPN transistors having the collector connected to terminal 84 of the primary winding and the emitter thereof connected to terminal 82 of the primary winding 36. The terminal 94 of the drive winding 48 is chosen such that it presents a positive voltage during the interval just prior to generating the spark. The anode 100 of the diode 96 is connected to a second semiconductor switch 102 such as a silicon controlled rectifier (SCR) having its anode 103 connected to the anode 100 of the diode 96 and its cathode 104 in circuit with the terminal 82 of the primary winding 36. The other terminal 106 of the drive coil 48 is connected to a peak detector circuit 109 comprising a capacitor 108 having resistors 110 and 112 connected in parallel thereacross. The other terminal of each of the resistors 110 and 112 is connected in circuit with the cathode 104 of the SCR 102. The junction 114 of the capacitor 108 and resistor 112 is connected to the SCR 102 through a diode 120. More particularly, the anode 122 of diode 120 is connected to the junction 114 and its cathode 124 is connected to the gate 126 of the SCR 102.

Figure 4:
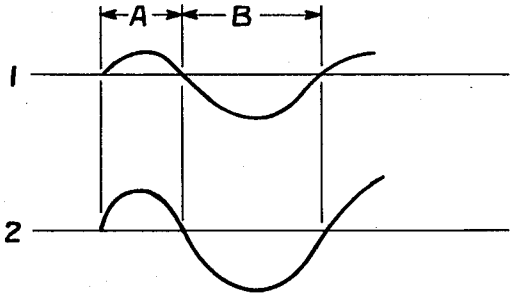
FIG. 4 illustrates waveforms generated by the invention.

In operation as the magnet 16 passes the stator, generally sinusoidal shaped voltages are induced within the primary winding 36 and the drive winding 48. FIG. 4, line 1 is illustrative of the induced voltage in the drive winding 48 at terminal 106 relative to ground while line 2 is illustrative of the voltage induced in the primary winding 36 at terminal 82 relative to ground. It should be noted that the polarity markings shown on the drive coil 48 and on the capacitor 108 illustrate the voltages induced and or stored during the second portion (B) of the waveforms shown in FIG. 4. During the first portion (A) of the waveforms of FIG. 4 the voltages induced in the drive coil 48 and capacitor 108 will be opposite to that indicated in FIG. 2. As the magnet 16 continues to pass the stator 14, the voltage induced therein will reverse during portion B of the cycle during which time a substantial current will be permitted to flow through the primary coil 36 and the output 95*a–b* of the Darlington pair 90. During this portion of the cycle, the capacitor 108 will substantially charge to the peak voltage of the waveform induced in the drive coil 48. Just after charging to the peak voltage of the drive winding (48), the voltage on capacitor 108 is communicated to the gate 126 of the SCR 102, thus rendering the SCR conductive thereby turning off the Darlington pair 90. The turning off of the Darlington pair 90 effectively terminates current flow through the primary winding 36. As a result thereof, the magnetic field in the primary abruptly collapses inducing in the secondary winding 38 an extremely high voltage which causes the spark plug 84 to fire.

Many changes and modifications in the above-described embodiment of the invention can of course be carried out without departing from the scope thereof. Accordingly, that scope is intended to be limited only by the scope of the appended claims .

What is claimed is:

1. A retrofit ignition module for replacing mechanical breaker points of an ignition system comprising the mechanical breaker points, a generally U-shaped stator including a crossbar and two substantially parallel legs extending therefrom, an ignition coil wound about said crossbar including a primary winding and a secondary winding and a magnet for producing a variable flux field in said core, the module comprising a single drive winding adapted to be circumferentially received about one of said legs for generating an induced voltage signal in response to engine rotation, said module further comprising means for supporting said driving winding and a control circuit housed within said supporting means and positioned between a core leg and said ignition coil wherein said control circuit is responsive to said induced voltage signal and connected in circuit with said drive winding and said primary winding and operable to control the flow of current through said primary winding;

a first semiconductor switch including an input and an output connected in parallel across said primary circuit for providing, when conductive, a path in which primary current flows, a second semiconductor switch, having an input, and an output connected to said input of said first switch for controlling the conductivity of said first switch, such that when said second switch is off said first switch is conductive or on, said second switch connected in circuit with one terminal of said drive winding, the other terminal of said drive winding connected to said input of said second switch through a capacitor and diode, such that during intervals when said induced voltage at said one terminal is positive said second switch is rendered conductive thereby turning off said first switch to terminate current flow through said primary winding;

wherein a plurality of resistors are connected across said capacitor forming in combination with said capacitor a peak detector circuit.

2. The module as defined in claim 1 wherein said second switch comprises an SCR having its anode connected to the input of said first switch and its cathode connected to a terminal of said resistors opposite said capacitor and to a first terminal of said primary winding that exhibits a negative voltage during the time said one terminal is positive.

3. The module is defined in claim 2 wherein said first switch comprises a Darlington pair having its emitter connected to said first terminal and its collector connected to the other terminal of said primary winding.

4. The module as defined in claim 3 wherein said other terminal is grounded.

5. A retrofit ignition module for an ignition system comprising a generally U-shaped stator including a crossbar and two substantially parallel legs extending therefrom, an ignition coil wound about said crossbar including a primary winding and a secondary winding and a magnet for producing a variable flux field in said core, the module comprising a drive winding adapted to be circumferentially received about one of said legs for generating an induced voltage signal in response to engine rotation, said module further comprising means for supporting said drive winding and a control circuit housed within said supporting means and postioned between a core leg and said ignition coil wherein said control circuit is responsive to said induced voltage signal and connected in circuit with said drive winding and said primary winding and operable to control the flow of current through said primary winding, said control circuit including a first semiconductor switch including an input and an output connected in parallel across said primary circuit for providing, when conductive, a path in which primary current flows, a second semiconductor switch, having an input, and an output connected to said input of said first switch for controlling the conductivity of said first switch, such that when said second switch is off said first switch is conductive or on, said second switch connected in circuit with one terminal of said drive winding, the other terminal of said drive winding connected to said input of said second switch through a capacitor and diode, such that during intervals when said induced voltage at said one terminal is positive said second switch is rendered conductive thereby turning off said first switch to terminate current flow through said primary winding and a plurality of resistors connected across said capacitor forming in combination with said capacitor a peak detector circuit.

6. The module as defined in claim 5 wherein said second switch comprises an SCR having its anode connected to the input of said first switch and its cathode connected to a terminal of said resistors opposite said capacitor and to a first terminal of said primary winding that exhibits a negative voltage during the time said one terminal is positive.

7. The module is defined in claim 6 wherein said first switch comprises a Darlington pair having its emitter connected to said first terminal and its collector connected to the other terminal of said primary winding.

8. The module as defined in claim 7 wherein said other terminal is grounded.

* * * * *